US010234211B2

(12) United States Patent
Ariyama et al.

(10) Patent No.: US 10,234,211 B2
(45) **Date of Patent: *Mar. 19, 2019**

(54) HEAT EXCHANGER

(71) Applicant: MAHLE FILTER SYSTEMS JAPAN CORPORATION, Tokyo (JP)

(72) Inventors: Masahiro Ariyama, Yokohama (JP); Kenji Wada, Kawagoe (JP); Tadashi Nishikoba, Fujimino (JP)

(73) Assignee: MAHLE FILTER SYSTEMS JAPAN CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/223,466

(22) Filed: Jul. 29, 2016

(65) Prior Publication Data

US 2017/0030661 A1 Feb. 2, 2017

(30) Foreign Application Priority Data

Jul. 30, 2015 (JP) ..... 2015-150184

(51) Int. Cl.
*F28D 9/00* (2006.01)
*F28F 13/06* (2006.01)
(Continued)

(52) U.S. Cl.
CPC ..... *F28D 9/005* (2013.01); *F01M 5/002* (2013.01); *F28D 1/03* (2013.01); *F28D 9/0037* (2013.01);
(Continued)

(58) Field of Classification Search
CPC ..... F28F 13/06; F28F 3/086; F28F 9/0221; F28F 2250/06; F28F 3/044; F28D 9/005;
(Continued)

(56) References Cited

U.S. PATENT DOCUMENTS 4,708,199 A * 11/1987 Yogo ..... F28D 9/0012 165/167
5,760,333 A * 6/1998 Kitahara ..... H01L 23/427 165/80.3
(Continued)

FOREIGN PATENT DOCUMENTS

CA 2839884 A1 * 8/2014 ..... F28D 7/0008
DE 19654365 A1 * 6/1998 ..... F28D 9/005
(Continued)

OTHER PUBLICATIONS

DE19654365A1 English Machine Translation—Retrieved Sep. 2017.*
(Continued)

*Primary Examiner* — Len Tran
*Assistant Examiner* — Jenna M Hopkins
(74) *Attorney, Agent, or Firm* — Foley & Lardner LLP

(57) ABSTRACT

A core unit 1 of a heat exchanger includes a plurality of core plates that are stacked on one another to alternately constitute oil passages 10 and cooling water passages 11, in which oil that is heat-exchanged in the core unit 1 is guided to an outlet port 23 after passing through a top connecting passage 18 and an oil outlet passage L3, and in which part of the oil is led from a lower end of an upper/lower oil passage L2 is guided to the outlet port 23 through an auxiliary passage 24, so that the amount of oil flowing in the oil outlet passage L3 is reduced thereby reducing a passage resistance.

4 Claims, 9 Drawing Sheets

(51) Int. Cl.

| | |
|---|---|
| ***F28D 1/03*** | (2006.01) |
| ***F28F 3/04*** | (2006.01) |
| ***F28F 3/08*** | (2006.01) |
| ***F28F 9/02*** | (2006.01) |
| ***F01M 5/00*** | (2006.01) |
| *F28D 21/00* | (2006.01) |

(52) U.S. Cl.
CPC ..... *F28D 9/0075* (2013.01); *F28D 9/0093* (2013.01); *F28F 3/044* (2013.01); *F28F 3/086* (2013.01); *F28F 9/026* (2013.01); *F28F 9/0221* (2013.01); *F28F 13/06* (2013.01); *F28D 2021/0089* (2013.01); *F28F 2250/06* (2013.01); *F28F 2280/06* (2013.01)

(58) Field of Classification Search
CPC ..... F28D 9/0093; F28D 1/03; F28D 9/0037; F28D 9/0075
USPC ..... 165/167, 166
See application file for complete search history.

(56) References Cited

U.S. PATENT DOCUMENTS

| | | | | | |
|---|---|---|---|---|---|
| 5,964,280 | A * | 10/1999 | Wehrmann | F28D 9/005 | 165/140 |
| 5,964,283 | A * | 10/1999 | Pavlin | F28D 9/005 | 123/196 AB |
| 7,762,090 | B2 * | 7/2010 | Lee | B01D 5/0015 | 165/113 |
| 9,759,498 | B2 * | 9/2017 | Kim | F28F 27/02 | |
| 2002/0066552 | A1 * | 6/2002 | Komoda | B23K 1/0012 | 165/133 |
| 2007/0261832 | A1 * | 11/2007 | Ware | F28D 9/005 | 165/167 |
| 2010/0206516 | A1 * | 8/2010 | Muller-Lufft | F01M 5/002 | 165/96 |
| 2012/0061060 | A1 * | 3/2012 | Stoll | F01M 5/002 | 165/133 |
| 2012/0205085 | A1 * | 8/2012 | Ariyama | F28F 3/027 | 165/181 |
| 2012/0216562 | A1 * | 8/2012 | Kadle | B60H 1/00899 | 62/434 |
| 2012/0325446 | A1 * | 12/2012 | Wakamatsu | F28F 3/044 | 165/167 |
| 2013/0081794 | A1 * | 4/2013 | Tuchowski | F28D 9/00 | 165/165 |
| 2014/0069137 | A1 * | 3/2014 | Wu | F25B 1/00 | 62/498 |
| 2014/0224455 | A1 * | 8/2014 | Kalbacher | F25B 39/04 | 165/104.21 |
| 2015/0101781 | A1 * | 4/2015 | Kim | F01P 3/12 | 165/96 |
| 2016/0018169 | A1 * | 1/2016 | Powell | F28F 13/06 | 165/109.1 |
| 2016/0161192 | A1 * | 6/2016 | Kim | F25B 40/00 | 165/167 |
| 2016/0209119 | A1 * | 7/2016 | Martin | F28D 9/0093 | |
| 2016/0282053 | A1 * | 9/2016 | Bardeleben | F28F 9/0248 | |
| 2018/0080693 | A1 * | 3/2018 | Wang | H01M 10/613 | |

FOREIGN PATENT DOCUMENTS

| | | | | | |
|---|---|---|---|---|---|
| DE | 102009022919 | A1 * | 12/2010 | F01M 5/002 | |
| DE | 102009034752 | A1 * | 2/2011 | F01M 5/002 | |
| EP | 1522812 | A2 * | 4/2005 | F28D 9/00 | |
| JP | 64-22177 | U | 2/1989 | | |
| JP | 2002-332818 | A | 11/2002 | | |
| JP | 2006-17430 | A | 1/2006 | | |
| JP | 2011007410 | A * | 1/2011 | | |
| JP | 2011007411 | A * | 1/2011 | | |
| JP | 2012127645 | A * | 7/2012 | F28D 9/005 | |
| JP | 2013007516 | A * | 1/2013 | F28F 3/044 | |
| JP | WO 2014027514 | A1 * | 2/2014 | F28F 9/0251 | |
| JP | WO 2014073471 | A1 * | 5/2014 | F28D 9/005 | |
| JP | WO 2015025908 | A1 * | 2/2015 | B23K 1/0012 | |
| WO | WO 2014/027514 | A1 | 2/2014 | | |
| WO | WO 2014/073471 | A1 | 5/2014 | | |

OTHER PUBLICATIONS

JP2011007410A English Machine Translation—Retrieved Sep. 2017.*
JP2011007411A English Machine Translation—Retrieved Sep. 2017.*
JP2013007516A English Machine Translation—Retrieved Sep. 2017.*
WO 2014027514A1 English Machine Translation—Retrieved Sep. 2017.*
DE 102009034752 A1 Machine Translation—Retrieved Aug. 2018.*
Extended European Search Report, dated Jan. 19, 2017, 6 pages.
USPTO Notice of Allowance, U.S. Appl. No. 15/341,473, dated Jul. 18, 2018, 10 pages.

* cited by examiner

HEAT EXCHANGER

BACKGROUND OF THE INVENTION

1. Field of the Invention

The present invention relates in general to a heat exchanger that includes a plurality of relatively thin core plates of aluminum alloy or the like that are stacked on one another to constitute a core unit.

2. Description of the Related Art

In order to clarify the present invention, two conventional heat exchangers of the above-mentioned type will be briefly described in the following.

One is a heat exchanger that is disclosed and described in Laid-open Japanese Patent Application (tokkai) 2002-332818. The heat exchanger of this publication comprises a plurality of core plates that are stacked on one another to constitute a heat exchanging core unit, and a bottom plate that is thicker than each core plate and has the heat exchanging core unit tightly mounted thereon through brazing. The stacked core plates are constructed to form both oil passages and cooling water passages which are alternately arranged. Upon usage of the heat exchanger, the bottom plate is fixed to a partner member or device.

The other one is a heat exchanger that is disclosed and described in Laid-open Japanese Patent Application (tokkai) 2006-17430. The heat exchanger of this publication comprises a plurality of core plates that are stacked on one another to constitute an oil flow core unit in which only oil flow passages are formed, and a housing that receives therein the oil flow core unit leaving therebetween cooling water passages. The publication shows a modification of the heat exchanger in which a bypass oil passage extends from an oil inlet port to an oil outlet port bypassing the oil flow core unit. The bypass oil passage extends horizontally between a top face of the oil flow core unit and an upper part of the housing.

SUMMARY OF THE INVENTION

Usually, in case of an oil cooler as the heat exchanger, a heat quantity subjected to heat exchange and pressure loss (or passage resistance) of oil flowing through the heat exchanger have a so-called trade-off relation, and thus, in order to increase the performance of the heat exchanger, it is necessary to establish both the heat quantity and the pressure loss (or passage resistance) at a high level. For achieving this, it is desirable to suppress the passage resistance without lowering the heat quantity that is subjected to heat exchange.

As is described hereinabove, in the heat exchanger of Laid-open Japanese Patent Application (tokkai) 2006-17430, the bypass oil passage extending from the oil inlet port to the oil outlet port does not contribute to heat exchanging. Thus, in this heat exchanger, although the passage resistance can be sufficiently reduced, the heat exchanging fails to have a satisfied heat quantity, and thus, the bypass passage provided does not contribute to increase in overall performance of the heat exchanger.

In accordance with the present invention, there is provided a heat exchanger which comprises a core unit including a plurality of core plates that are stacked on one another; and a bottom plate member that mounts thereon the core unit, the bottom plate including one or a plurality of plate members, wherein the core unit includes a first passage that extends in the stacking direction of the core unit to guide a fluid to one end of the stacking direction of the core unit while being communicated with fluid passages defined between the core plates and a second passage that is isolated from the fluid passages defined between the core plates and extends in the stacking direction of the core unit to guide the fluid to the other end of the stacking direction, wherein the core unit has at a lower surface thereof both an end of the first passage and an end of the second passage, wherein the bottom plate has a fluid port that serves as an outlet/inlet opening connected to the end of the second passage, and wherein the bottom plate has an auxiliary passage that connects the end of the first passage to the fluid port.

In a preferred embodiment, the fluid port is an outlet for the fluid, so that the fluid having passed through the fluid passages defined between the core plates is guided to a top side of the core unit through the first passage and then guided to a bottom side of the core unit through the second passage while causing part of the fluid to flow from an end opening of the first passage to the fluid port through the auxiliary passage.

In this embodiment, the fluid that is heat-exchanged during flow in the fluid passages defined between the core plates is guided to the top side of the core unit through the first passage, and the fluid is finally guided to the bottom side of the core unit through the second passage and to the fluid port (viz., fluid outlet) of the bottom plate. Now, it is to be noted that in the present invention, part of the fluid flowing in the first passage is led to the fluid port (fluid outlet) from the end opening of the bottom surface of the core unit through the auxiliary passage. That is, part of the fluid that has passed through the fluid passages defined between the core plates and come to the first passage is divided into flows and directed to the fluid port (fluid outlet) without passing through the second passage. Accordingly, the amount of the fluid flowing in the second passage, which causes the passage resistance, is reduced and thus, the passage resistance or pressure loss is reduced. Since the fluid led to the auxiliary passage is the fluid that has been heat-exchanged during flow in the fluid passages defined between the core plates, sufficient heat exchange amount is assured.

In the other embodiment, the fluid port is an inlet for the fluid, and the fluid having been guided to the top side of the core unit through the second passage is guided to the fluid passages defined between the core plates while flowing toward the bottom surface side of the core unit after passing through the first passage, and part of the fluid is led from the fluid port to the lower end of the first passage through the auxiliary passage.

In this embodiment, the fluid that has been led from the fluid port (fluid inlet) is guided to the top side of the core unit through the second passage, and then, the fluid is forced to flow through the fluid passages defined by the core plates. In the invention, part of the fluid is led from the fluid port (fluid inlet) to the end opening of the first passage through the auxiliary passage. Accordingly, the amount of the fluid flowing through the second passage, which causes the passage resistance, is reduced, and thus, the passage resistance or pressure loss is reduced. Since part of the fluid led to the first passage through the auxiliary passage is forced to certainly flow through the fluid passages defined between the core plates, sufficient heat exchange amount is assured.

In the present invention, in a fluid flow arrangement in which discharging of the fluid from the core unit to the fluid port after being heat-exchanged or introducing of the fluid from the fluid port to the core unit before being heat-exchanged is carried out through the second passage of the core unit, part of the fluid is divided into flows to provide a fluid communication between the fluid port and the first passage through the auxiliary passage. Thus, the passage resistance of the second passage can be reduced while assuring sufficient heat exchanging amount and thus the heat exchanging amount and the pressure loss, which have a so-called tradeoff relation therebetween, can be obtained at a higher level.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, four embodiments 100, 200, 300 and 400 of the present invention will be described in detail with reference to the accompanying drawings.

In the following description, various directional terms, such as, upper, lower, right, left, upward and the like are used for ease of understanding. However, such terms are to be understood with respect to only a drawing or drawings on which a corresponding part or portion is shown.

First, a heat exchanger 100 of the first embodiment of the present invention will be described with reference to FIGS. 1 to 9 of the drawings. As will become apparent as description proceeds, the heat exchanger 100 is of a multipath type heat exchanger.

The heat exchanger 100 shown is an oil cooler that is used for cooling hydraulic oil of an automotive automatic transmission with the aid of cooling water.

Figure 1:
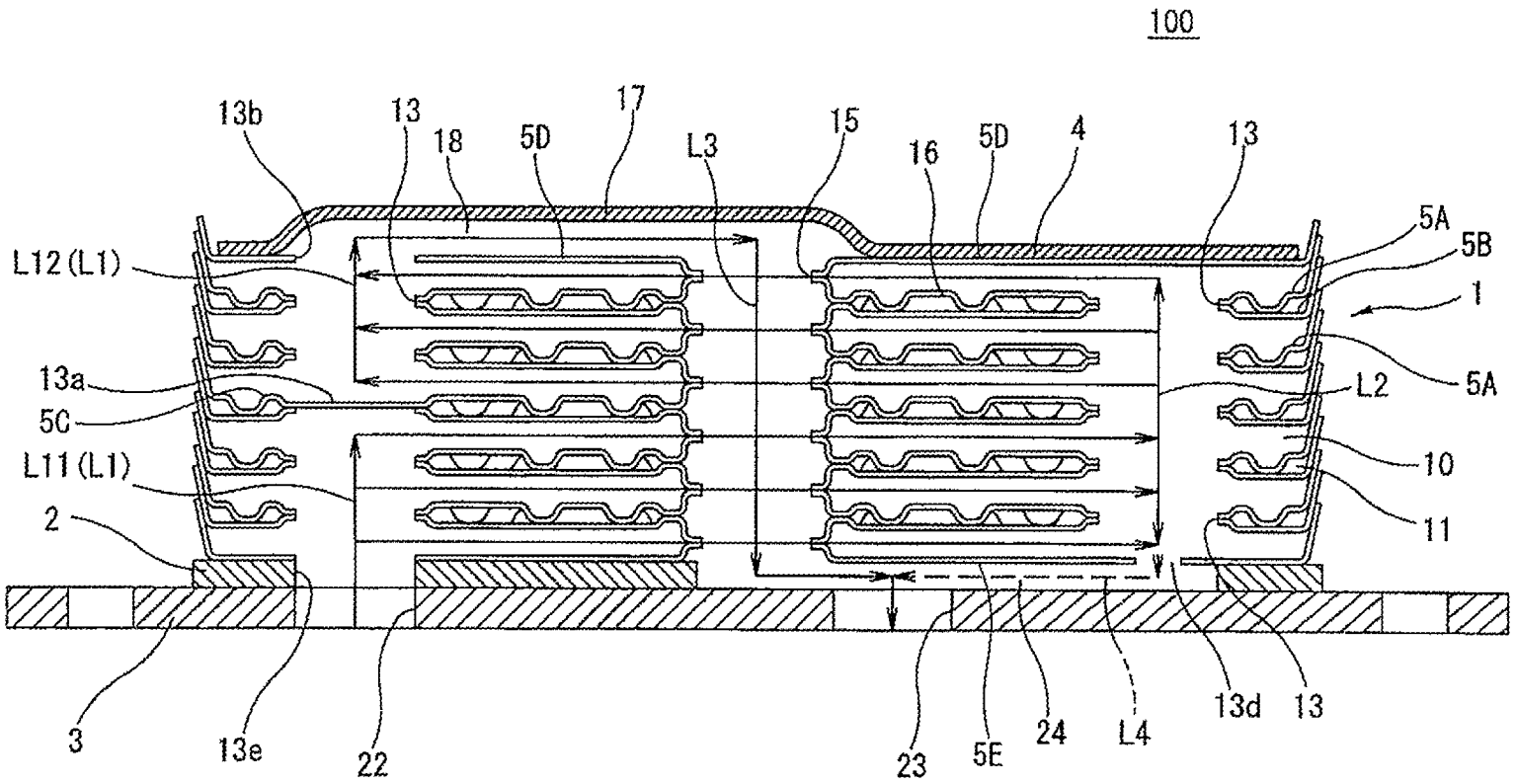
FIG. 1 is a sectional view of a heat exchanger of a first embodiment of the present invention.
Figure 2:
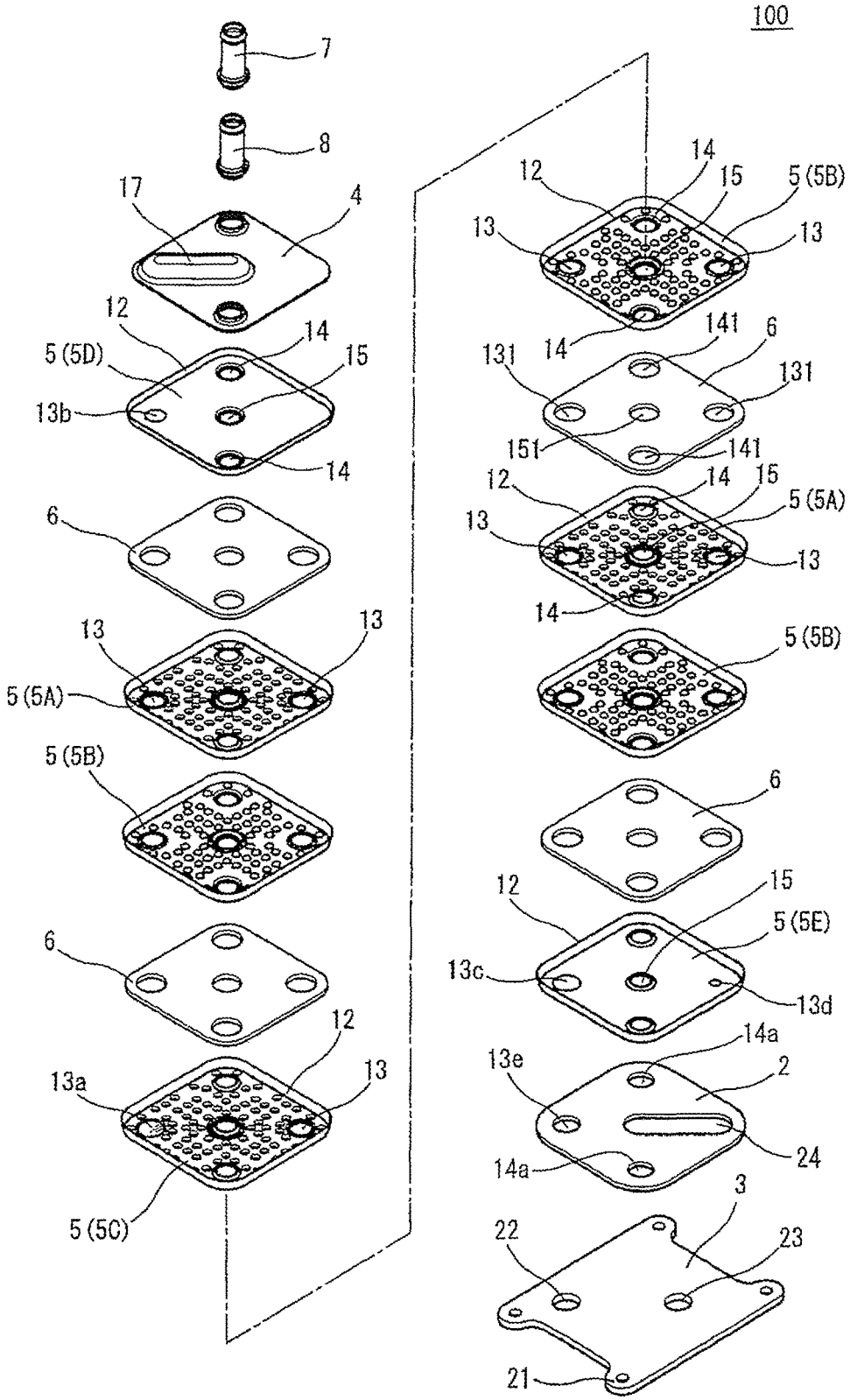
FIG. 2 is an exploded perspective view of the heat exchanger of the first embodiment.

As is seen from FIGS. 1 and 2, the heat exchanger 100 has a first rectangular bottom plate 2 and a second rectangular bottom plate 3, and these two bottom plates 2 and 3 are made of relatively thick plate. Actually, the bottom plate 2 is tightly disposed on the bottom plate 3. As shown from these drawings, the second rectangular bottom plate 3 is larger and thicker than the first rectangular bottom plate 2.

On the first rectangular bottom plate 2, there is tightly mounted a core unit 1 that includes a plurality of rectangular core plates 5 and a plurality of rectangular fin plates 6 that are stacked on one another in an after-mentioned manner.

On the core unit 1, there is tightly mounted a rectangular top plate 4 that is thicker than the rectangular core plate 5.

As is seen from FIG. 2, to the rectangular top plate 4, there are tightly connected water inlet and outlet pipes 7 and 8. For such connection, the rectangular top plate 4 is formed with tapered openings (no numerals) to which the pipes 7 and 8 are tightly connected.

In the heat exchanger 100 of the first embodiment, almost all of the parts and elements, such as the above-mentioned first and second bottom plates 2 and 3, the core plates 5, the fin plates 6, the top plate 4 and the pipes 7 and 8, are made of aluminum-based material.

For producing the heat exchanger 100, the above-mentioned parts that are originally separated are pre-assembled to constitute a pre-assembled unit and set in a holding tool and then together with the holding tool, the pre-assembled unit is put into a furnace to be heated for a certain time. With this, various parts are integrally brazed to one another. As a method for supplying brazing material, the core plates 5 may be constructed of a clad material. That is, the core plates 5 may be constructed of an aluminum based material as a base metal and a brazing material, such as an aluminum based material whose melting point is lower than that of the base metal, may be coated on a given surface of the base metal. Otherwise, sheet-like brazing material may be used, which is put between two plates that are to be brazed.

As is seen from FIG. 2, the core unit 1 comprises the plurality of rectangular core plates 5 that are stacked on one another together with the rectangular fin plates 6. As shown, the core plates 5 are basically the same in shape and shaped like a shallow dish. As is seen from FIG. 1, with such stacking, between every two adjacent core plates 5, there are alternately formed an oil passage 10 and a cooling water passage 11.

Figure 3:
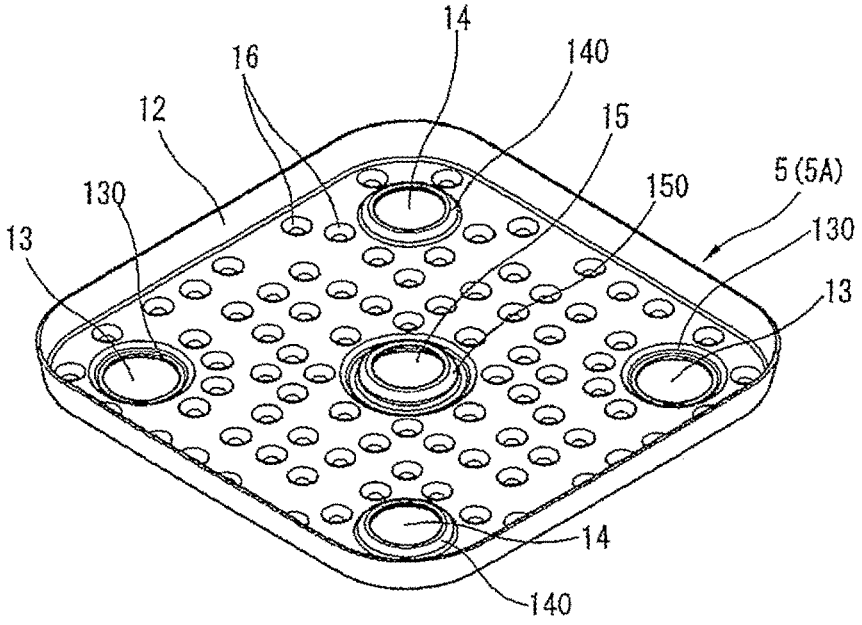
FIG. 3 is a perspective view of a lower core plate.
Figure 4:
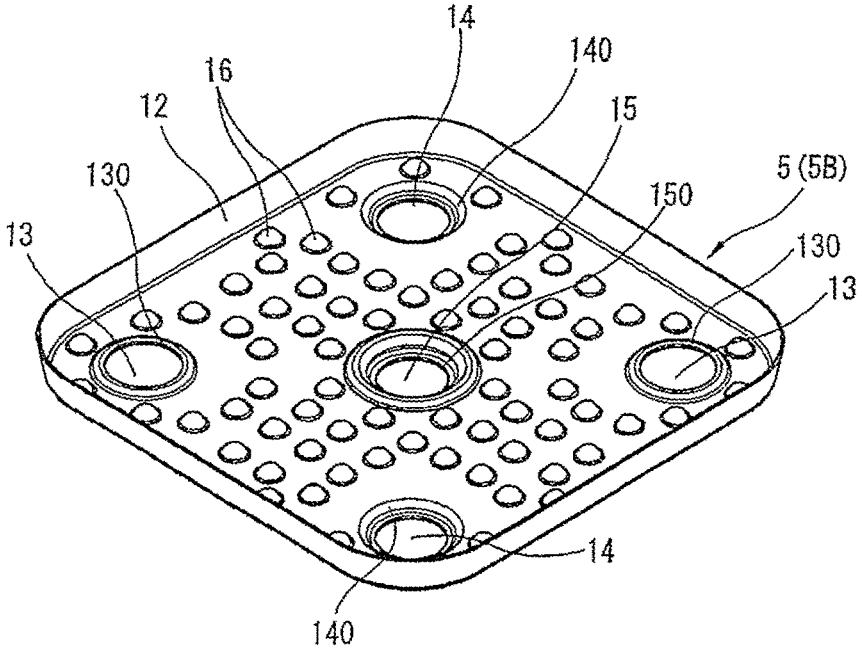
FIG. 4 is a perspective view of an upper core plate.

Actually, as the core plates 5, a plurality of different types of cores plates 5 are used, each core plate 5 having different fine portions. Generally, the plurality of rectangular core plates 5 are classified into two groups. One group includes lower side core plates 5A as shown in FIG. 3 each being placed below the oil passage 10 and the other group includes upper side core plates 56 as shown in FIG. 4 each being placed above the oil passage 10. Upon assembly, every paired plates 5A and 5B having the fin plate 6 put therebetween are stacked on one another (in other words, the fin plates 6 are put in the passages 10).

As is seen from FIG. 2, each rectangular core plate 5 is formed with a tapered flange portion 12. Upon assembly, the flange portion 12 of the upper side core plate 5B is put on the flange portion 12 of the lower side core plate 5A and brazing is applied to mutually contacting surfaces of these two core plates 5B and 5A, so that the oil passage 10 or the cooling water passage 11 is defined between the two core plates 5B and 5A. Actually, due to the stacked arrangement of the upper side core plates 5B and the lower side core plates 5A, the oil passage 10 and the cooling water passage 11 are arranged vertically and alternately as is seen from FIG. 1.

It is now to be noted that the number of the stacks shown in FIG. 1 and that shown in FIG. 2 are different. That is, in FIG. 2, some of the stacks each including the lower side core plate 5A and the upper side core plate 5B are omitted, and in FIG. 1, the fin plates 6 are not shown.

As is seen from FIGS. 3 and 4, each core plate 5 (viz., lower and upper side core plates 5A and 5B) is formed at first diagonally opposed end portions thereof with respective circular oil flow openings 13 that serve as part of oil flow passages, and at second diagonally opposed end portions thereof with respective circular cooling water flow openings 14 that serve as part of cooling water flow passages.

Furthermore, as is seen from such drawings, each core plate 5 is formed at a center portion thereof with a circular oil outlet opening 15 that serves as part of an oil outlet passage.

As will be understood from FIGS. 2, 3 and 4, when the plurality of the core plates 5 are stacked to constitute the core unit 1, the circular oil flow openings 13, the circular cooling water flow openings 14 and the circular oil outlet openings 15 are respectively aligned in a vertical direction.

As is seen from FIGS. 3 and 4, each circular oil flow opening 13, each circular cooling water flow opening 14 and each circular oil outlet opening 15 are formed with respective annular bosses 130, 140 and 150. It is to be noted that as is seen from FIG. 3 the annular bosses 130 provided by each of the lower side core plates 5A are depressed downward and the annular bosses 140 and 150 provided by each of the lower side core plates 5A are depressed upward. It is further to be noted that as is seen from FIG. 4 the annular bosses 130 provided by each of the upper side core plates 58 are depressed upward and the annular bosses 140 and 150 provided by each of the upper side core plates 5B are depressed downward.

Thus, by respectively joining the annular bosses 130, the annular bosses 140 and the annular bosses 150, each oil passage 10 and each cooling water passage 11 are hermetically sealed. Due to provision of such passages 10 and 11, after-mentioned oil passage and cooling water passage aligned in the vertical direction are provided.

Referring back to FIGS. 3 and 4, each of the core plates 5 is formed with dimples 16 that project to the cooling water passage 11. Each dimple 16 has a hemispherical or truncated cone shape. As is seen from FIG. 1, these dimples 16 are placed in the cooling water passage 11, and tops of the dimples 16 of the lower side core plates 5A are connected to flat surfaces of the upper side core plates 5B and tops of the dimples 16 of the upper side core plates 5B are connected to flat surfaces of the lower side core plates 5A.

Although not well shown in the drawings, each of the fin plates 6 is of a common type having fine fins. As shown in FIG. 2, each fin plate 6 is formed with two circular openings 131 that correspond to the circular oil flow openings 13 of the core plate 5, two circular openings 141 that correspond to the circular cooling water flow openings 14 of the core plate 5 and a circular opening 151 that corresponds to the circular oil outlet opening 15 of the core plate 5. The diameter of each opening 131, 141 or 151 is larger than that of the corresponding boss 130, 140 or 150.

The heat exchanger 100 of the first embodiment is of a multipath type heat exchanger.

Figure 5:
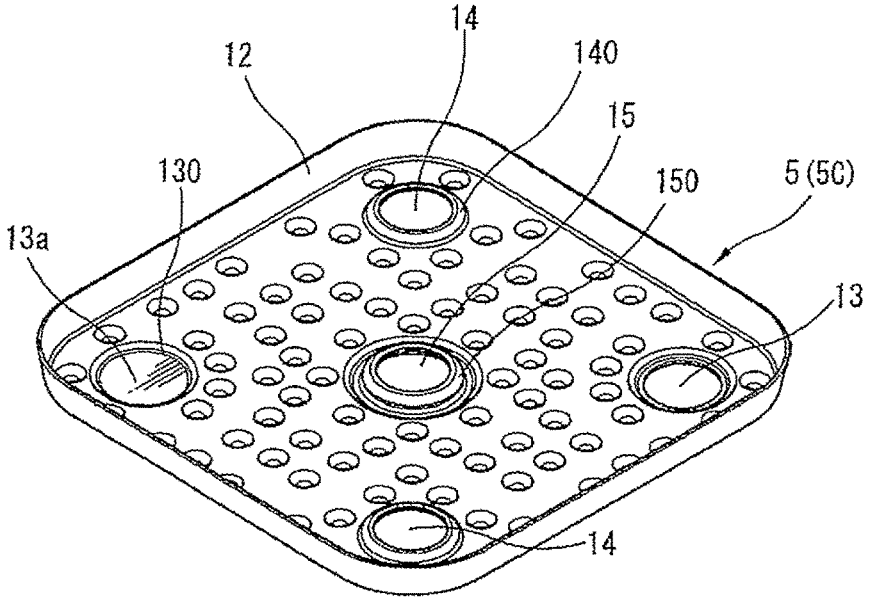
FIG. 5 is a perspective view of a lower core plate that is arranged in a middle position.

That is, in the heat exchanger 100, a plurality of oil passages 10 are stacked on one another together with their associated core plates and in the core plate 5 (viz., either one of the lower side core plate 5A and the upper side core plate 5B) that provides the oil passages in a vertically middle portion of the stacked core plates, one of the circular oil flow openings 13 is closed as is seen from FIG. 5. Actually, such core plate will be called as a middle-positioned lower side core plate 5C in the following explanation. As shown in FIG. 5, in the middle-positioned lower side core plate 5C, one of the circular oil flow openings 13 is closed by a closing part 13*a* that has an annular boss 130.

Figure 6:
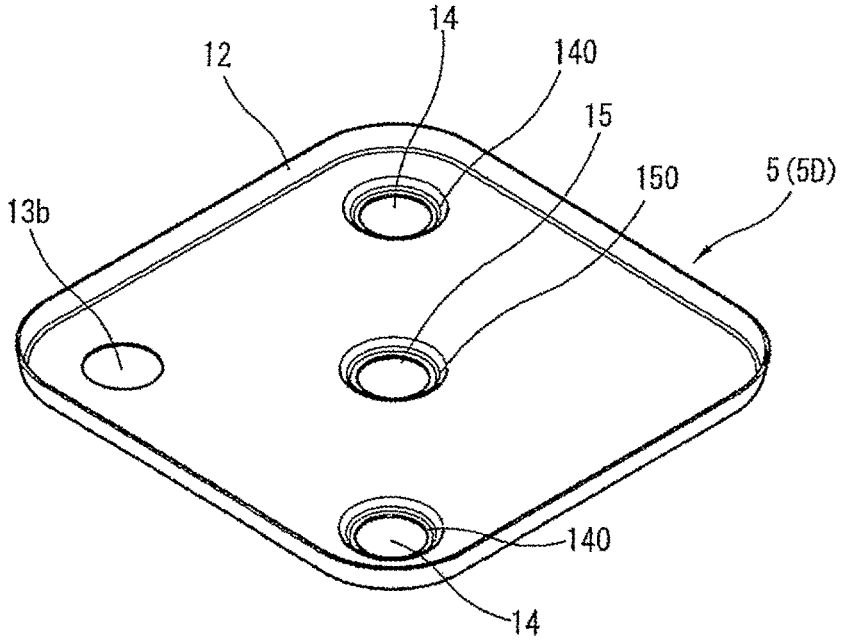
FIG. 6 is a perspective view of an upper core plate that is arranged at an uppermost position.

In FIG. 6, there is shown an uppermost upper side core plate 5D that is arranged at an uppermost position of the stacked core plates as is seen from FIG. 1. The detail of this uppermost upper side core plate 5D is well shown in FIG. 6.

As is seen from FIGS. 2 and 6, the uppermost upper side core plate 5D is mated with the top plate 4 and has no dimples 16 formed thereon. The uppermost upper side core plate 5D has at one of diagonally opposed end portions a circular oil flow opening 13*b* that has no annular boss 130.

Figure 7:
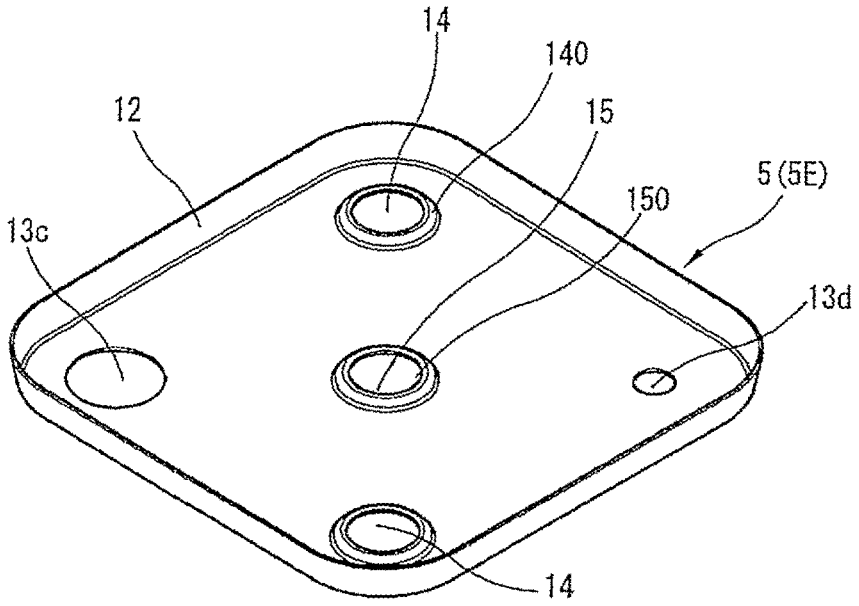
FIG. 7 is a perspective view of a lower core plate that is arranged at a lowermost position.

In FIG. 7, there is shown a lowermost lower side core plate 5E that is arranged at a lowermost position of the stacked core plates as is seen from FIG. 1.

As is seen from FIGS. 2 and 7, the lowermost lower side core plate 5E is in close contact with a first bottom plate 2 (see FIG. 8) and has no dimples 16 formed thereon. The lowermost lower side core plate 5E has at one of diagonally opposed end portions a circular oil flow opening 13*c* that has no annular boss 130, and at the other one of diagonally opposed end portions a smaller diameter circular auxiliary oil flow opening 13*d* that has no annular boss. In the illustrated embodiment, the circular oil flow opening 13*d* is made smaller in diameter for adjusting or restricting an flow rate of oil flowing. The size of the auxiliary oil flow opening 13*d* can be the same in diameter as the diameter of other oil flow openings 13 in accordance with the oil flow rate needed. The detail of the lowermost lower side core plate 5E is well shown in FIG. 7.

As is seen from FIG. 1, on the top portion of the core unit 1 including the stacked core plates 5, there is mounted the rectangular top plate 4. That is, the top plate 4 is brazed to an upper surface of the uppermost upper side core plate 5D. The top plate 4 has two circular cooling water flow openings (no numerals) at positions corresponding to those of the two circular cooling water flow openings 14 of the uppermost upper side core plate 5D.

As is seen from FIG. 2, to the two circular cooling water flow openings of the top plate 4, there are respectively connected the water inlet and outlet pipes 7 and 8. The top plate 4 is formed with a diagonally extending swelled part 17 that, when coupled with the uppermost upper side cover plate 5D, constitutes a top connecting oil passage 18 (see FIG. 1) extending from the circular oil flow opening 13*b* of the uppermost upper side core plate 5D to the circular oil outlet opening 15 of the core plate 5D.

Figure 8:
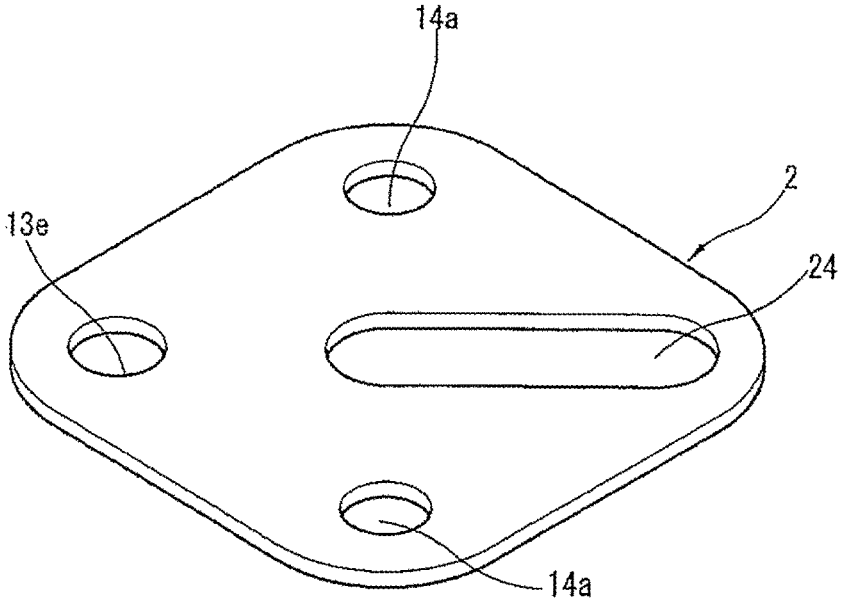
FIG. 8 is a perspective view of a first bottom plate.
Figure 9:
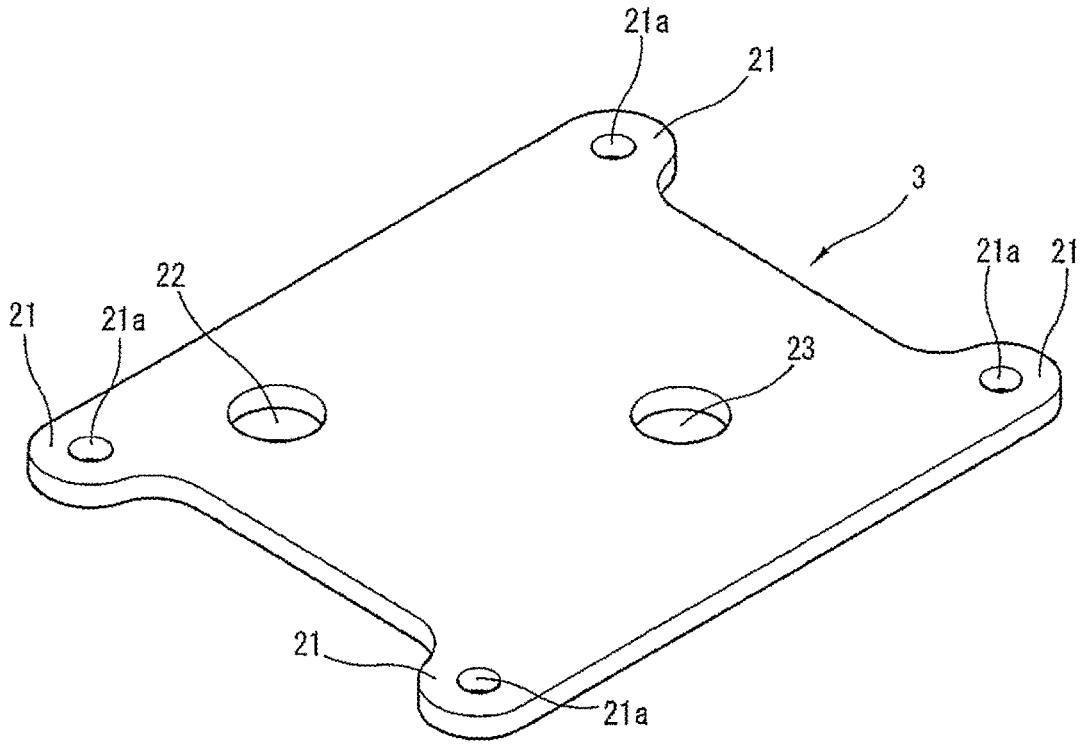
FIG. 9 is a perspective view of a second bottom plate.

As is seen from FIGS. 1, 8 and 9, the first rectangular bottom plate 2 is mounted onto the second rectangular bottom plate 3 to constitute a bottom plate unit.

As is shown in FIG. 9, the second rectangular bottom plate 3 is formed at four projected corners 21 thereof with respective connecting openings 21*a*. The second bottom plate 3 has, at a portion corresponding to that of one of the circular oil flow openings 13 of the core plate 5, a circular oil inlet port 22, and, at a portion corresponding to that of the other one of the circular oil flow openings 13 of the core plate 5, a circular oil outlet port 23.

It is to be noted that the oil cooler 100 is tightly mounted to a control valve housing, etc., of an automatic transmission through the four projected corners 21 of the second rectangular bottom plate 3. Upon mounting, the oil inlet and outlet ports 22 and 23 are connected to oil outlet and inlet openings (not shown) provided by the automatic transmission, respectively.

As is seen from FIGS. 1 and 2, the first bottom plate 2 is put between and brazed to a lower surface of the lowermost lower side core plate 5E and an upper surface of the second bottom plate 3, and as is seen from FIG. 8, the first bottom plate 2 is formed with two circular cooling water flow openings 14*a* at portions corresponding to those of the water flow openings 14 of the core plate 5. Furthermore, the first bottom plate 2 is formed with a circular oil flow opening 13*e* at a portion corresponding to that of one of the circular oil flow openings 13 of the core plate 5. Furthermore, the first bottom plate 2 is formed with a diagonally extending elongate opening 24 that, when coupled with both the second bottom plate 3 and the core plate 5E, connects to the circular oil outlet opening 15 of the core plate 5E, the smaller diameter circular auxiliary oil flow opening 13*d* of the core plate 5E and the oil outlet port 23 of the second bottom plate 3.

As will be understood from FIG. 1, when the above-mentioned various parts are stacked and brazed to one another in the above-mentioned manner to constitute the oil cooler 100, there are formed in the core unit 1 various passages that extend in the stacked direction. Through these passages, the oil passages 10 provided by the stacked core plates constitute the oil flow passage that extends from the oil inlet port 22 to the oil outlet port 23.

More specifically, as is seen from FIG. 1, in the core unit 1, there are formed an upper/lower oil passage L1 defined by the one-side oil flow openings 13 of the core plates 5 that are aligned above the oil inlet port 22, an upper/lower oil passage L2 defined by the other-side oil flow openings 13 of the core plates 5 and an oil outlet passage L3 defined by the oil outlet openings 15 of the core plates 5, which are composed as passages in stacked direction. As shown, due to provision of the closing part 13*a* of the middle-positioned lower side core plate 5C, the upper/lower oil passage L1 is divided into a lower side upper/lower oil passage L11 and an upper side upper/lower oil passage L12.

As is seen from FIG. 1, the lower side upper/lower oil passage L11 has a lower open end exposed to and directly connected to the oil inlet port 22.

In the illustrated embodiment 100, the oil flow openings 13*e* of the first and second rectangular bottom plates 2 and 3 and the oil inlet port 22 are shown to have the same diameter as the circular oil flow openings 13 of the core plates 5. However, the present invention is not limited to such dimensional unification. That is, the openings 13*e* of the bottom plates 2 and 3 and the oil inlet port 22 may have a different diameter from the oil flow openings 13 of the core plates 5.

As shown in FIG. 1, the upper side upper/lower oil passage L12 has an upper open end exposed to and directly connected to a top connecting passage 18 provided below the top plate 4. The lower side and upper side upper/lower passages L11 and L12 are connected to each of the oil passages 10 defined by the lower side and upper side core plates 5A and 5B.

As is seen from FIG. 1, the second upper/lower oil passage L2 produced by the other-side oil flow openings 13 of the core plates 5 has an upper end closed by the uppermost upper side core plate 5D and a lower open end exposed or connected to the circular auxiliary oil flow opening 13*d* of the lowermost lower side core plate 5E. The upper/lower oil passage L2 is connected to each of the oil passages 10 defined by the core plates 5A and 5B.

As is seen from FIG. 1, the oil outlet passage L3 provided at a center of the core unit 1 has an upper open end exposed to an upper connecting passage 18 defined just below the rectangular top plate 4 and has a lower open end exposed and connected to the auxiliary passage 24.

It is to be noted that the oil outlet passage L3 is separated and isolated from each of the oil passages 10 defined by the core plates 5A and 5B. That is, the oil in the oil outlet passage L3 is forced to flow only in the core plate stacked direction.

Accordingly, the oil outlet port 23 is connected to a lower end of the oil outlet passage L3 through the auxiliary passage 24, and at the same time, the oil outlet port 23 is connected to an auxiliary oil flow opening 13*d*, that is, to a lower end of the upper/lower oil passage L2 through the auxiliary passage 24, as shown.

It is to be noted that the upper/lower oil passage L2 corresponds to a first passage defined in Claim 1, and the oil outlet passage L3 corresponds to a second passages defined in Claim 1.

For clarification of the drawing, FIG. 1 does not show a cooling water passage that extends in the stacked direction and includes the circular cooling water flow openings 14 of the stacked core plates 5. Actually, like the upper/lower oil passage L2, due to the stacked arrangement of the cooling water flow openings 14, a pair of cooling water passages are formed, that extend in the stacked direction. These cooling water passages are respectively connected to the cooling water passages 11 each being defined between the core plates 5A and 5B. Accordingly, the cooling water is allowed to flow from one of the connectors 7 and 8 to the other of the connectors 7 and 8.

In the following, operation of the oil cooler 100 of the first embodiment will be described with the aid of the drawings.

First, the flow of oil in the oil cooler 100 established when an oil pump (not shown) is in operation will be described.

As is indicated by arrows in FIG. 1, the oil led from the oil inlet port 22 is forced to flow upward in the lower side upper/lower oil passage L11 and guided to oil passages 10 defined by the core plates located in a lower half part of the core unit 1. The oil cooled or heat exchanged by or with the cooling water during flow in the oil passages 10 is led to upper/lower oil s passage L2 of the opposite side and forced to flow upward in the passage L2 (that is, toward the top portion), and guided to the oil passages 10 defined by the core plates 5 located in an upper half part of the core unit 1. That is, the oil is forced to flow to make a U-turn in the core unit 1 from the lower half part of the core unit 1 to the upper half part of the same.

The oil further cooled during flow in the oil passages 10 located in the upper half part of the core unit 1 is led to the upper side upper/lower passage L12 and forced to flow upward in this passage L12, and then led to the oil outlet passage L3 through the top connecting passage 18. In the oil outlet passage L3, the sufficiently cooled oil is forced to flow downward and led to the oil outlet port 23 through part of the auxiliary passage 24.

The above-mentioned flow is a basic flow of oil.

However, in the first embodiment, there is provided a further flow of oil which is as follows.

As is seen from FIG. 1, from the lower open end of the upper/lower oil passage L2 to the oil outlet port 23, as is indicated by an arrow L4, there extends a bypass passage that includes an auxiliary oil flow opening 13*d* and an auxiliary passage 24, through which part of the oil from the lower end of the upper/lower oil passage L2 is led to the oil outlet port 23. That is, in the upper/lower oil passage L2, the oil having passed through the lower half part of the core unit 1 is divided into two flows, one being directed upward and other being directed downward, and one part of the oil is guided to the oil outlet port 23 through the bypass passage without flowing in the oil outlet passage L3.

Accordingly, an oil flow in the oil outlet passage L3, which causes a passage resistance, is reduced, and thus, the passage resistance and/or pressure loss of the oil cooler 100 can be reduced.

That is, if the above-mentioned bypass passage including the smaller auxiliary oil flow opening 13*d* and the part of the auxiliary passage 24 is not provided, all of oil led into the core unit 1 is forced to flow through the oil outlet passage L3. In this case, the oil flow rate per unit cross-sectional area of the oil flow passage is increased and thus the passage resistance is increased. Furthermore, in the oil cooler 100, the oil flow from the top connecting oil passage 18 to the oil outlet passage L3 is subjected to a sharp turning and thus the passage resistance is further increased.

However, in the oil cooler 100 of the first embodiment, the oil is forced to flow parallelly in both the oil outlet passage L3 and the auxiliary passage 24 and joined at the oil outlet port 23, and thus, the passage resistance in the core unit 1 is reduced. The oil led to the auxiliary passage 24 has been cooled (or heat exchanged) during flow in the oil passages 10 defined by the core plates 5, and thus, such oil can contribute to the heat exchanging of the oil cooler 100. In other words, in the oil cooler 100 of the first embodiment, by guiding part of the oil that has been cooled or heat exchanged to the oil outlet port 23 through the auxiliary passage 24, the passage resistance can be reduced while assuring satisfaction in the heat exchanging (or cooling), and the heat exchanging performance and the pressure loss performance, which have a trade-off relation therebetween in the oil cooler 100, are both achieved at a higher level.

It is to be noted that the oil flow rate in the auxiliary passage 24 can be controlled by adjusting the diameter of the auxiliary oil flow opening 13*d* of the lowermost lower side core plate 5E.

In the following, an oil cooler 200 of the second embodiment of the present invention will be described with reference to FIG. 10.

For simplification of description, only parts and portions that are different from those of the above-mentioned first embodiment 100 will be described in the following.

Figure 10:
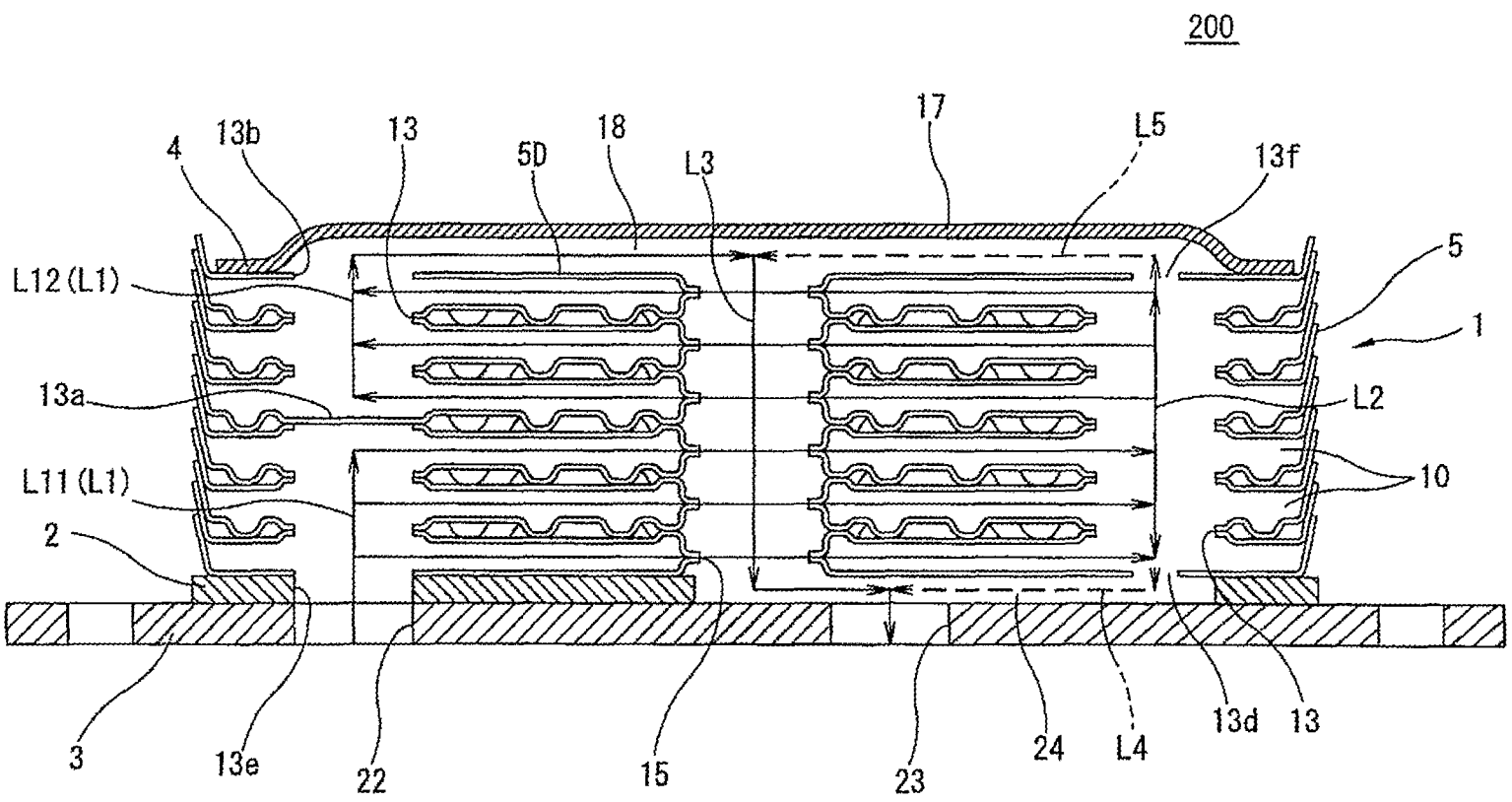
FIG. 10 is a sectional view of a heat exchanger of a second embodiment of the present invention.

As is seen from FIG. 10, in the second embodiment 200, the uppermost upper side core plate 5D is formed at an upper end of the upper/lower oil passage L2 with an oil bypass opening 13*f*, and the swelled part 17 of the top plate 4 extends diagonally while covering the oil bypass opening 13*f*. Accordingly, the upper end of the upper/lower oil passage L2 is connected to the top connecting oil passage 18 through the oil bypass opening 13*f*.

Accordingly, in the oil cooler 200 of the second embodiment, as is indicated by an arrow L5, part of the oil that has passed through the lower half of the core unit 1 is forced to flow from the oil bypass opening 13*f* to the center oil outlet passage L3 through the top connecting oil passage 18. That is, part of the oil is forced to flow while bypassing the upper half oil passages 10 of the core unit 1. Accordingly, the passage resistance and the pressure loss of the oil cooler 200 are further reduced. The bypass oil flow rate can be controlled by adjusting the diameter of the oil bypass opening 13*f*. The construction and function of the auxiliary passage 24 are the same as those of the above-mentioned first embodiment 100.

Figure 11:
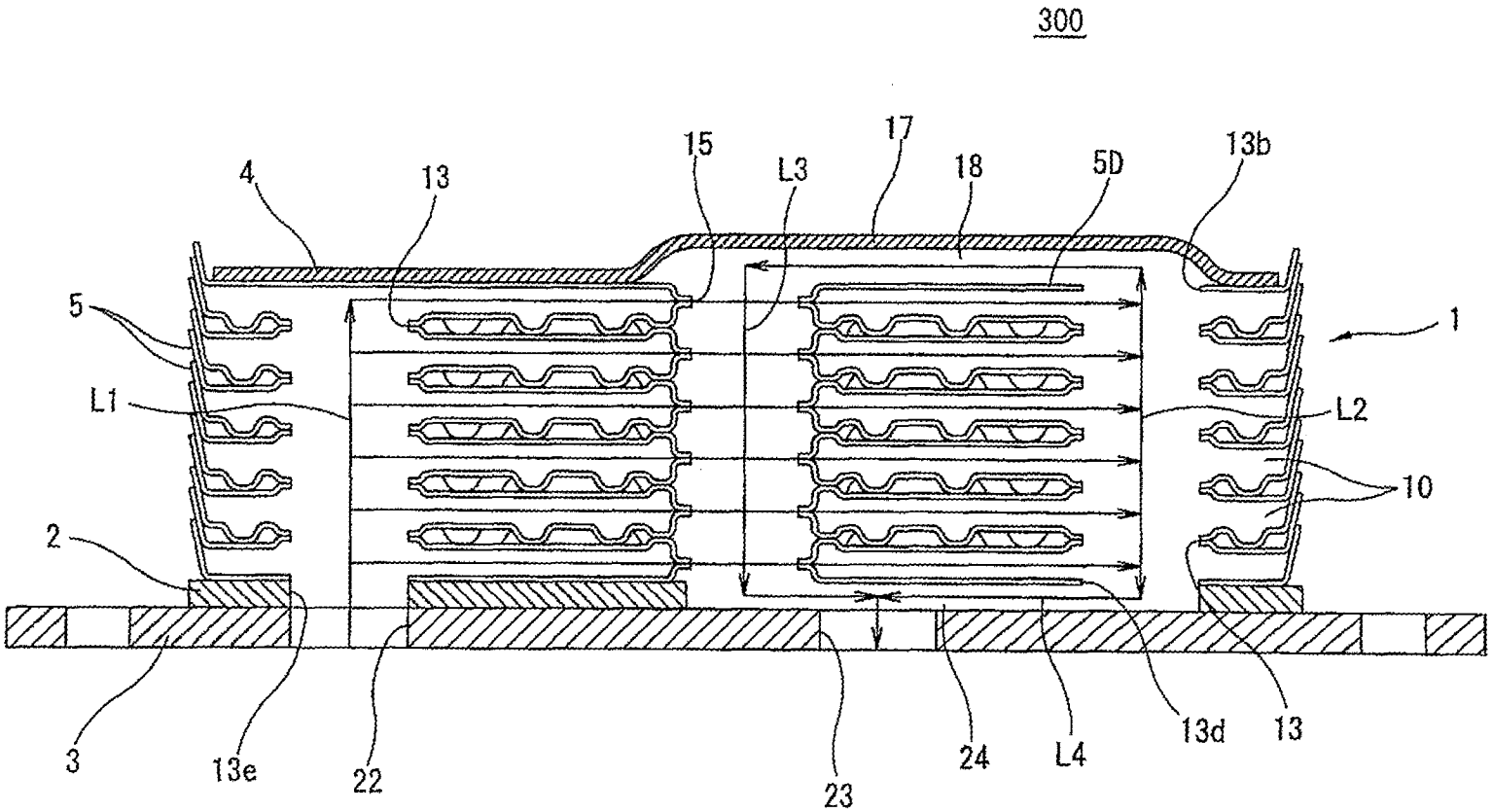
FIG. 11 is a sectional view of a heat exchanger of a third embodiment of the present invention.

In the following, an oil cooler 300 of the third embodiment of the present invention will be described with reference FIG. 11.

In this embodiment 300, the middle-positioned lower side core plate 5C (see FIGS. 1 and 5) having the closing part 13*a* (see FIG. 5) is not used, and the upper/lower oil passage L1 provided above the oil inlet port 22 is constructed to extend from a bottom part of the core unit 1 to the top part of the same. In this third embodiment, the position of the swelled part 17 of the top plate 4 and the position of the oil flow opening 13*b* of the uppermost upper side core plate 5D are opposite to those of the first embodiment. More specifically, the swelled part 17 and the oil flow opening 13*b* are positioned near the upper/lower oil passage L2.

Accordingly, in the oil cooler 300 of the third embodiment, the oil led into the core unit 1 from the oil inlet port 22 is equally and parallelly guided to all of the oil passages 10 and after heat exchanging the oil is led to the upper/lower oil passage L2. Then, the oil is guided from the upper/lower oil passage L2 to the center oil outlet passage L3 through the top connecting oil passage 18 provided by the swelled part 17. Like in the first and second embodiments 100 and 200, part of the oil is guided to flow from the lower end of the upper/lower oil passage L2 to the oil outlet port 23 through the auxiliary passage 24.

Accordingly, in the oil cooler 300 of the third embodiment, the oil that has been cooled (or heat exchanged) during its flow in all of the oil passages 10 is divided into two flows and then directed to the oil outlet port 23.

It is to be noted that in the illustrated example, the circular auxiliary oil flow opening 13*d* has the same diameter as the other circular oil flow openings 13.

Figure 12:
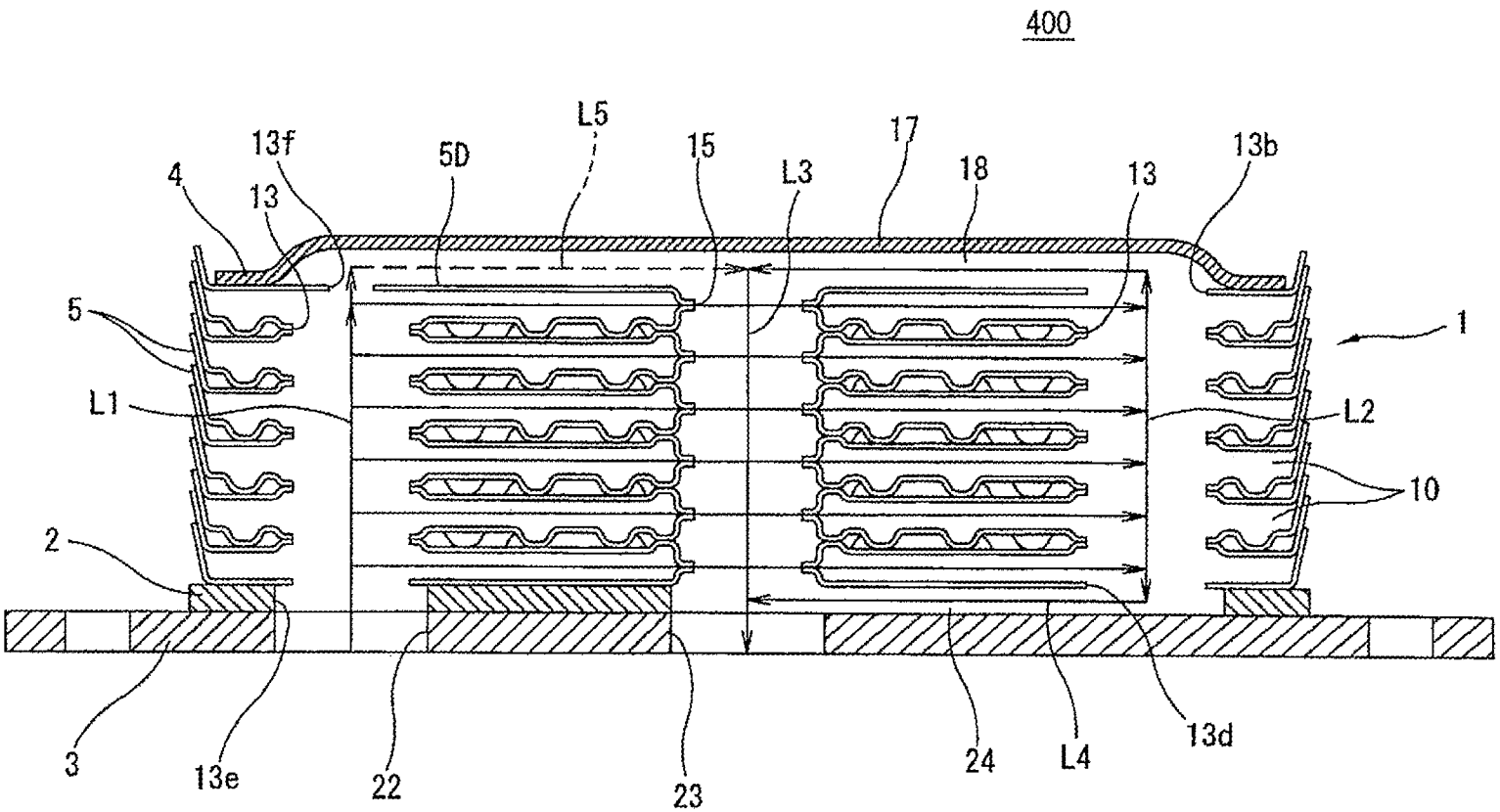
FIG. 12 is a sectional view of a heat exchanger of a fourth embodiment of the present invention.

In the following, an oil cooler 400 of the fourth embodiment of the present invention will be described with the aid of FIG. 12.

The oil cooler 400 of this fourth embodiment is substantially the same as the oil cooler 300 of the third embodiment except that in the fourth embodiment 400, the bypass passage of the second embodiment is further employed. That is, the uppermost upper side core plate 5D is formed at the upper end of the upper/lower oil passage L1 with the oil bypass opening 13*f*, and the swelled part 17 of the top plate 4 diagonally extends while covering the oil bypass opening 13*f*. Accordingly, the upper end of the upper/lower oil passage L1 that extends upward from the oil inlet port 22 is connected to the top connecting oil passage 18 through the oil bypass opening 13*f*.

Accordingly, in the oil cooler 400 of the fourth embodiment, as is indicated by the arrow L5, part of the oil that has been led from the oil inlet port 22 is forced to flow from the oil bypass opening 13*f* to the center oil outlet passage L3 through the top connecting oil passage 18. That is, part of the oil is forced to flow while bypassing the core unit 1. Thus, the passage resistance and the pressure loss of the oil cooler 400 of this fourth embodiment are reduced. The bypass oil flow rate can be controlled by adjusting the diameter of the oil bypass opening 13*f*. The construction and function of the auxiliary passage 24 are the same as those of the above-mentioned third embodiment 300.

If desired, the following modifications are possible in the present invention.

That is, in the above-mentioned four embodiments 100, 200, 300 and 400, the oil inlet port 22 and the oil outlet port 23 are placed in the illustrated positions. However, if desired, such ports 22 and 23 may be placed in opposite positions for running the oil in an opposite direction in the core unit 1. Of course, also in this modification, due to the function of the auxiliary passage 24, the pressure loss can be reduced without sacrificing the heat exchanging performance.

In the above embodiments 100, 200, 300 and 400, the oil passages 10 and the cooling water passages 11 are alternately produced by the stacked core plates 5 without usage of a core unit housing. However, if desired, such core unit housing may be used. In this case, the cooling water flows in the housing and the oil flows in the oil passages defined by the stacked core plates.

In the above-mentioned embodiments 100, 200, 300 and 400, the two bottom plates 2 and 3 are used for simplifying processing of the auxiliary passage 24. However, if desired, in place of the two bottom plates 2 and 3, one bottom plate with a groove like auxiliary passage may be used.

The entire contents of Japanese Patent Application 2015-150184 filed Jul. 30, 2015 are incorporated herein by reference.

Although the present invention has been described above with reference to the embodiments, the present invention is not limited to such embodiments as described above. More various modifications and variations of such embodiments may be carried out by those skilled in the art, in light of the above description.

What is claimed is:

1. A heat exchanger comprising:

a core unit including a plurality of core plates that are stacked on one another; and a bottom plate that mounts thereon the core unit, the bottom plate including at least one plate member;

wherein the core unit includes a first passage that extends in a stacking direction of the core unit to guide fluid to one end of the stacking direction of the core unit while being communicated with fluid passages defined between the core plates and a second passage that is isolated from the fluid passages defined between the core plates and extends in the stacking direction of the core unit to guide the fluid to another end of the stacking direction;

wherein the second passage is fluidly connected with the first passage in the fluid flow direction;

the core unit has at a lower surface thereof both an end of the first passage and an end of the second passage;

the bottom plate has a fluid port that serves as an outlet opening connected to the end of the second passage;

the bottom plate has an auxiliary passage that connects the end of the first passage to the fluid port;

the first passage and the fluid port are arranged such that fluid is led from a lower end of the first passage to the fluid port through the auxiliary passage, the fluid port is structured to receive fluid from the second passage, and fluid which the fluid port receives from the second passage exits the core unit through the fluid port;

fluid is guided to the fluid passages defined between the core plates while flowing toward a bottom side of the core unit, and the fluid port is structured to receive fluid from the second passage via the auxiliary passage; and the first passage, the second passage, and the auxiliary passage are structured such that fluid from a portion of the first passage and from a portion of the second passage meet proximate to an exit of the core unit.

2. A heat exchanger as claimed in claim 1, wherein the fluid port comprises an outlet for the fluid such that fluid having passed through the fluid passages defined between the core plates is guided to a top side of the core unit through the first passage and is then guided to the bottom side of the core unit through the second passage, and part of the fluid is directed from an end opening of the first passage to the fluid port through the auxiliary passage.

3. A heat exchanger as claimed in claim 1, wherein an upper surface of the core unit is formed with respective openings, to which a second end of the first passage and a second end of the second passage are exposed, and a top plate is mounted on the upper surface of the core unit to define a connecting passage through which the second end of the first passage and the second end of the second passage are connected.

4. A heat exchanger as claimed in claim 1, wherein the core unit is divided into a plurality of sections in the stacking direction, the sections are constructed such that fluid flows through the sections while making U-turns, and the first passage comprises an intermediate part of a U-turn passage for the fluid.

* * * * *